United States Patent [19]

Kyner, Jr.

[11] Patent Number: 4,542,759

[45] Date of Patent: Sep. 24, 1985

[54] PORTABLE SHELTER

[76] Inventor: Paul R. Kyner, Jr., R.D. 3, Box 3263, Berwick, Pa. 18603

[21] Appl. No.: 421,161

[22] Filed: Sep. 22, 1982

[51] Int. Cl.[4] ..... E04B 1/32; A45F 1/16

[52] U.S. Cl. ..... 135/102; 52/81; 135/DIG. 8

[58] Field of Search ..... 52/80, 646, DIG. 8, 52/81, 82, 648, 204, DIG. 14; 135/100, 101, 105, 106, 102, 97, 78

[56] References Cited

U.S. PATENT DOCUMENTS

| | | | |
|---|---|---|---|
| 3,270,755 | 9/1966 | Horvath | 135/97 |
| 3,273,574 | 9/1966 | Huddle | 135/97 |
| 3,386,456 | 6/1968 | Walker | 135/102 |
| 3,420,011 | 1/1969 | Takahashi | 52/648 |
| 3,710,806 | 1/1973 | Kelley | 52/81 |
| 3,798,849 | 3/1974 | Biggs | 52/80 |
| 3,854,254 | 12/1974 | Janosko | 52/82 |
| 3,861,107 | 1/1975 | Papayoti | 403/172 |

FOREIGN PATENT DOCUMENTS

| | | | |
|---|---|---|---|
| 496035 | 9/1950 | Belgium | 52/82 |
| 981867 | 1/1976 | Canada | 52/81 |

OTHER PUBLICATIONS

Geodesics by Popko, Figures 71 and 72.

*Primary Examiner*—John E. Murtagh
*Attorney, Agent, or Firm*—Randall G. Erdley

[57] ABSTRACT

A geodesic type shelter having the shape of a semi-ellipsoid of revolution having a large opening in one side and being constructed of elements which are all removably connected together so that it is particularly useful as a portable airplane hangar.

20 Claims, 25 Drawing Figures

PORTABLE SHELTER

This application relates to copending patent applications Ser. Nos. 421357 and 421358, filed Sept. 22, 1982 in the name of the same applicant.

FIELD OF THE INVENTION

This invention relates to a shelter having a geodesic structure that can easily be erected and taken down and is primarily for use as a portable aircraft hangar.

DESCRIPTION OF THE PRIOR ART

The general aviation aircraft owner and airports themselves are faced with a critical shortage of hangar space. This is true of large and small airports across the United States and many other countries. Almost all aircraft hangars are permanently constructed of large structural members, are provided with concrete floors, and require large doors to allow aircraft to be moved into and out of for sheltered storage. These hangar structures due to their expensive construction costs and permanent character are not economically feasible or practical for a general aviation pilot who merely needs an inexpensive hangar which will shelter, in most instances, a single aircraft and which is so simple to erect and dismantle that he can easily move it from one airport, or airstrip, to another as desired. Of course, the hangar must also be strong enough to withstand prevailing winds and serve as an adequate shelter from the wind, sun, rain and snow. Such hangars for a small aircraft owner are not presently available and he is usually required to park his plane in the open and tie it down where it is completely exposed to the elements.

BRIEF SUMMARY OF THE INVENTION

My invention overcomes the above problems and has the primary object of providing a lightweight yet strong and durable hangar which is immensly practical for general aviation pilots, and aircraft and airport owners.

A further object of my invention is to provide an aircraft hanger which is inexpensive particularly for the individual aircraft owner and small airport operator.

A further object of my invention is to provide a practical aircraft hangar which is constructed of lightweight members which can easily be erected and taken down by a minimum number of people, and when disassembled can be loaded into a small truck or trailer, for example, and moved to another location in a short period of time.

These objectives are accomplished by my invention which comprises a geodesic type structure having an elliptical shape constructed of elongated structural members of a suitable material such as steel or aluminum pipe, steel or aluminum beams, wood or heavy duty plastic, for example, to form a framework of interrelated triangles. The vertices of each of these triangles lies on the surface of an ellipsoid of revolution cut in half by a plane (the ground plane) passing through the ellipsoid at its equator (diametral plane).

For application as an aircraft hangar, or other storage facility needing a large door a substantial portion of the geodesic structure is omitted in accordance with the invention. This provides for entrance and exit of an airplane or other large objects. To compensate for this loss of support from the omitted portion a truss is provided. This structure will be referred to as an open structure and can be covered by a tarpaulin, fabric or pliable material either suspened from the inside, pulled over the outside, or attached to each triangle. If a door covering is desired this may be accomplished by using extra covering material and allowing it to be pulled down from the truss opening and secured to the ground much like a tent flap. An optional covering comprised of solid panels of triangular shape fitted between the structural members of the framework can also be used. These panels may be fabricated from suitable materials, e.g. aluminum sheet, aluminum sheet and foam composite, fiberglass panels, fiberglass and foam composite panels, ferrocement, and ferrocement and foam composite panels. Such panels if sufficiently strong and formed into correctly shaped triangles can be attached to one another and erected without benefit of the frame.

The elliptical form and geodesic structure combines the structural advantages of the spherical geodesic structure with a shape that provides a more efficient utilization of space. A spherical shape provides for the enclosure of a maximum space for the minimum surface area. However, in most cases much of this space cannot be utilized. For example, in the case of a hangar to house an airplane with a thirdy foot wing span, a dome approximately 40 feet in diameter would be required. If the dome had a spherical configuration it would have a 20 foot height. However, if the dome had an elliptical configuration in accordance with the invention and for example with a ratio of major to minor axis of 1.6, the height of the 40 foot dome would be 12.5 feet. In this example, if there is no need to utilize the upper space (which will be true in most cases) the elliptical configuration has the advantages of (1) less surface material needed to cover the structure, (2) less wind resistance thereby decreasing the strength requirements of the members, and (3) less construction materials.

Due to the unique structure of the invention and its inherently practical features of ease of assembly and disassembly and low cost optimum use of materials other uses will become apparent such as shelters for boats, farm equipment, farm produce, automobiles, or when covered with transparent material as a greenhouse, or solar air heater. For the application not needing a large opening, a section of the structure need not be omitted and therefore needs no additional support.

BRIEF DESCRIPTION OF THE DRAWING

The invention will now be described in greater detail with reference to the accompanying drawing, in which like reference members are employed to indicate like parts, wherein.

DETAILED DESCRIPTION

Figure 1:
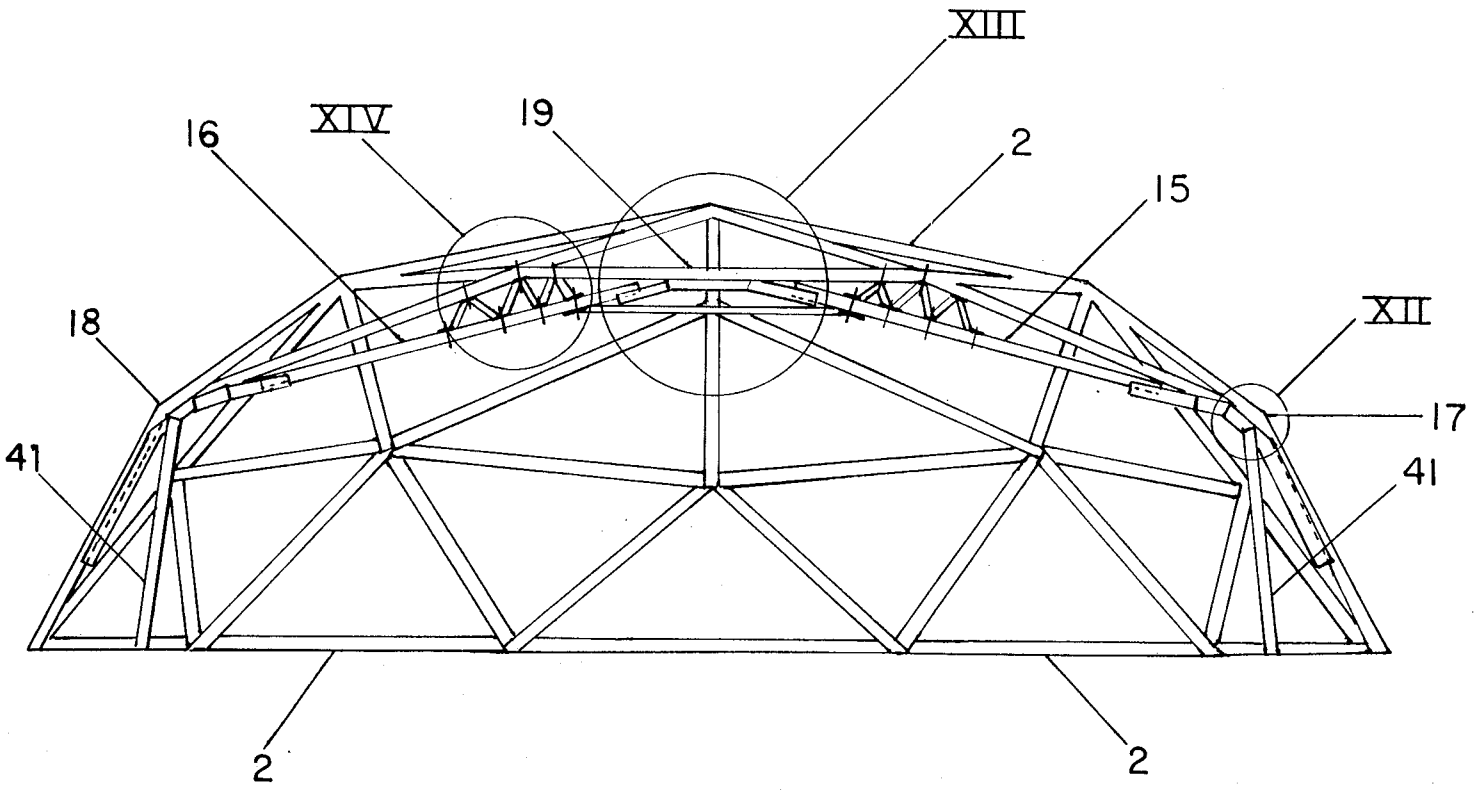
FIG. 1 is a front elevation view showing the invention from the open side.
Figure 2:
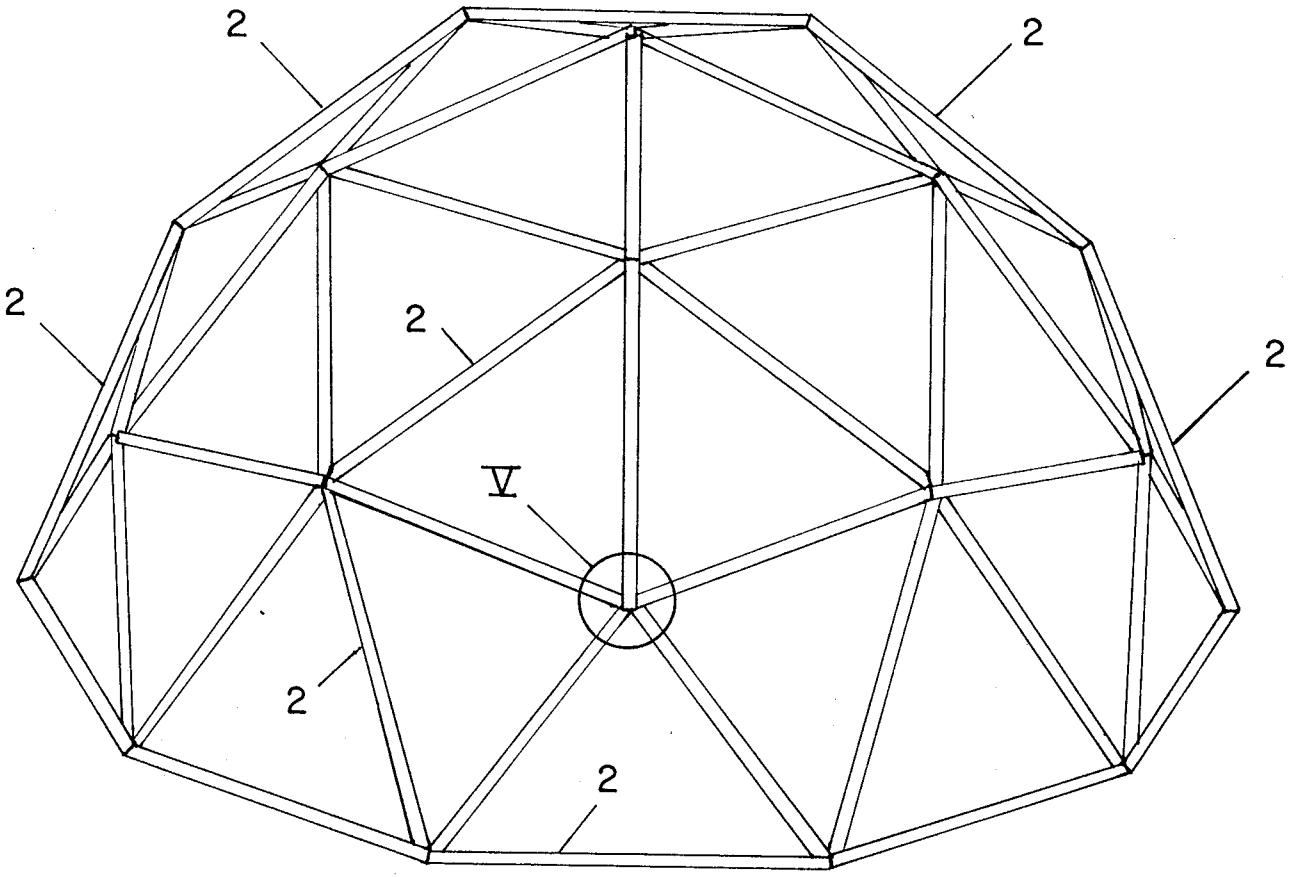
FIG. 2 is a top plan view of FIG. 1.
Figure 3:
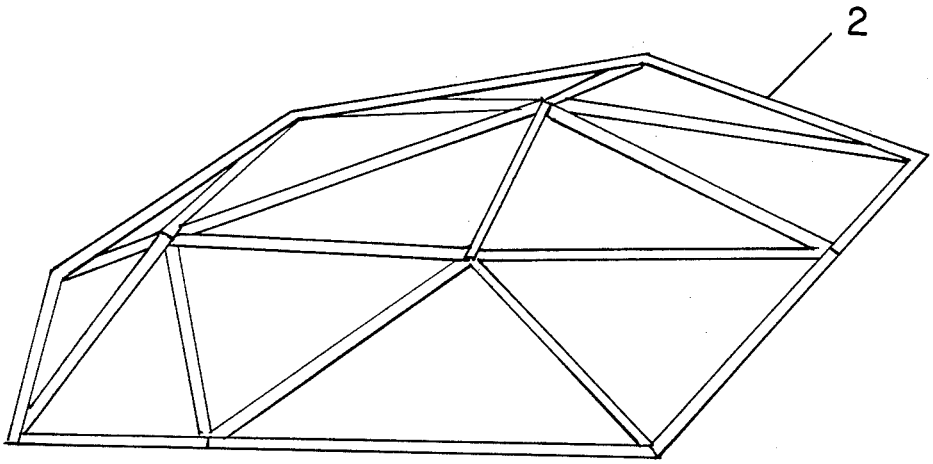
FIG. 3 is a left side view of FIG. 1.
Figure 5:
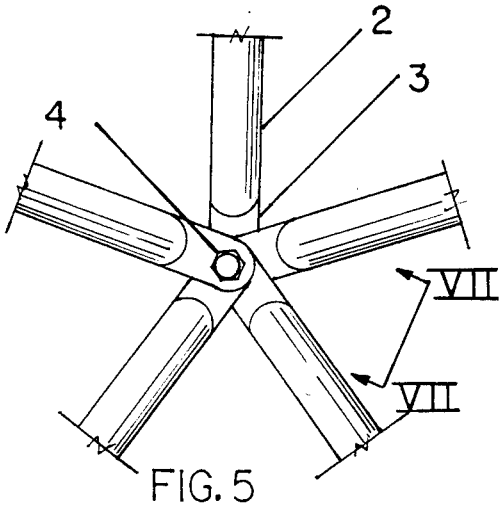
FIG. 5 is an enlarged plan view of one embodiment of a connecting joint for the structural members such as circled at V in FIG. 2.
Figure 6:
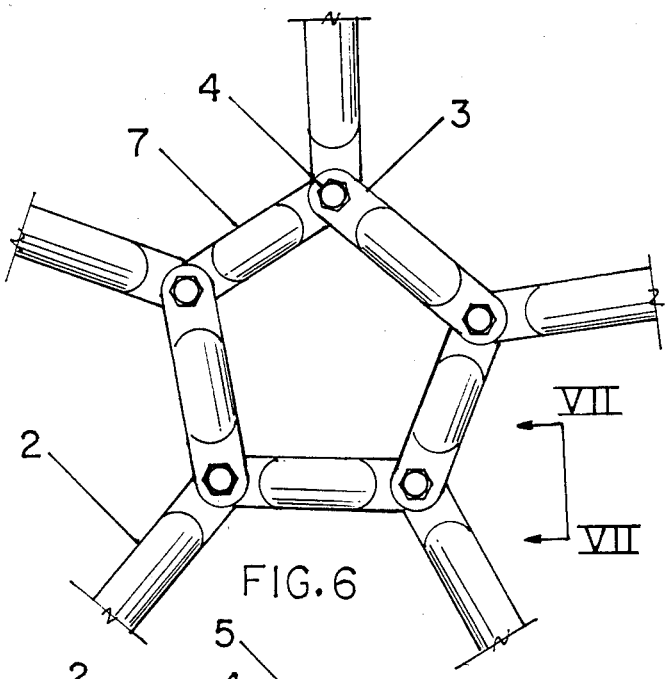
FIG. 6 is an enlarged plan view of another embodiment of a connecting joint.
Figure 7:
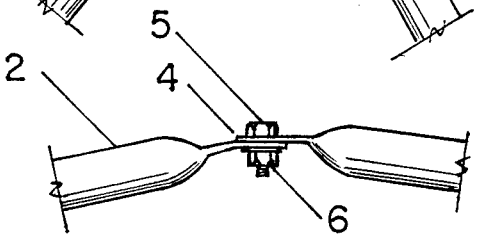
FIG. 7 is a side elevation view of FIG. 5 or FIG. 6 taken from line VII—VII but showing only two members connected.

Referring to the drawings, FIGS. 1, 2 and 3 show front, top and side views, respectively, of the completed structure of the invention made from elongated structural elements 2 connected at their ends to form a geodesic framework. These structural elements 2 are in the preferred embodiments tubular steel or aluminum members flattened at their ends 3, as shown in FIGS. 5, 6 and 7, and drilled to produce holes 4 in the flattened ends. In the embodiment of FIG. 5 flattened ends 3 are overlapped with the holes aligned and held together by a bolt 5 inserted through the holes and nut 6 tightly clamping the ends together.

Another form of connection is shown in FIG. 6 wherein short tubular links 7 having flattened ends span between the ends of adjacent structural members 2 and are connected thereto by a bolt and nut arrangement similar to that shown in FIG. 7.

Figure 8:
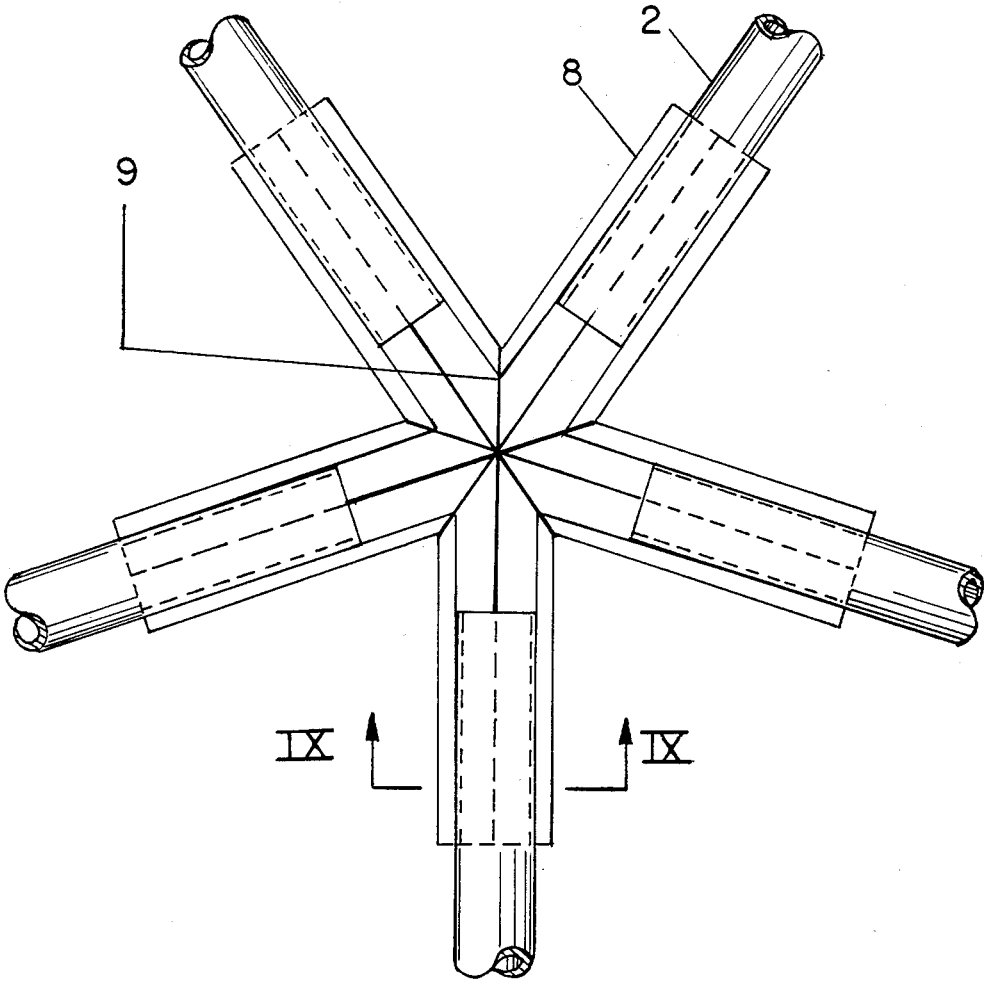
FIG. 8 is an enlarged top plan view of another embodiment of a connecting joint.
Figure 9A:
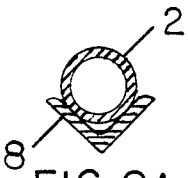
FIG. 9*a* is a cross-sectional view taken along line IX—IX of FIG. 8.
Figure 9B:
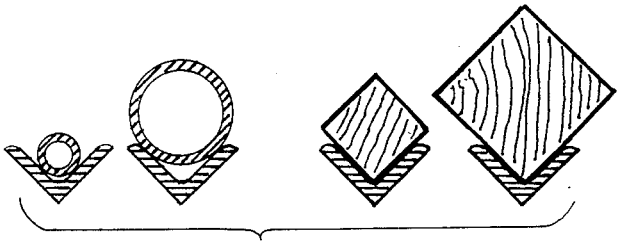
FIG. 9*b* is a schematic drawing showing the self-aligning function of the connector of FIG. 8 irrespective of the size of the elements.

An alternate type of connection shown in FIG. 8 can also be used. In this form flattening of the ends of elements 2 can be eliminated and the ends are merely joined to a star-shaped connector made of angle iron, or similar structural material. The angle material is cut to the required length for the legs 8 to provide adequate stability and the leg members are then cut at the inner ends at the required angle, to fit together as shown after which they are joined together by welding, for example, at their inner edges 9. The ends of structural elements 2 are then fitted between the flanges of legs 8 as shown in FIG. 9 and can be attached thereto by bolts and nuts, (not shown) by inserting the bolts through aligned holes through the angle pieces and elements 2. For a more permanent installation, elements 2 may be welded to angle members 8.

Figure 10:
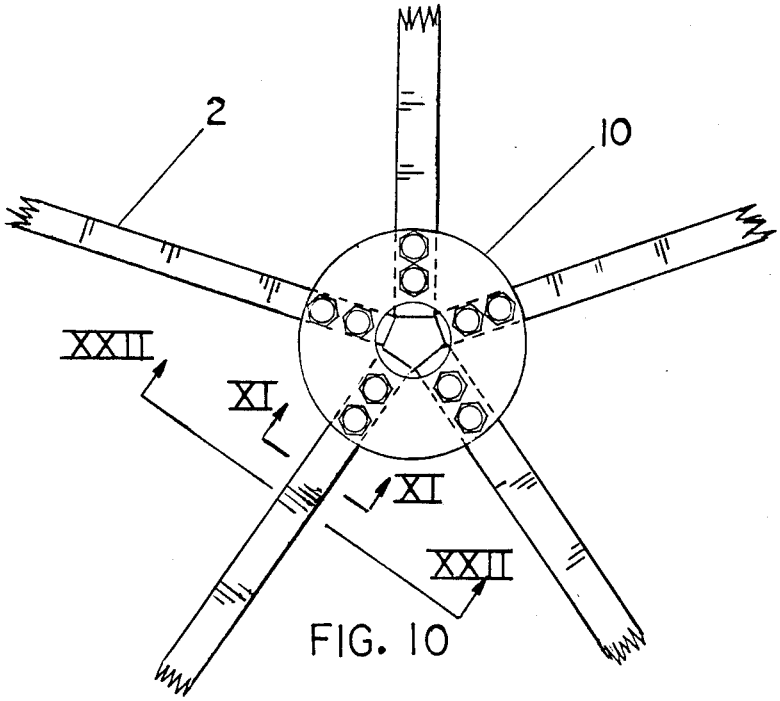
FIG. 10 is an enlarged view of another embodiment of a connecting joint.
Figure 11A:
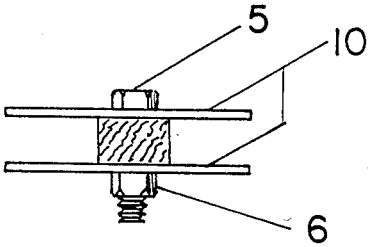
FIG. 11A is a cross-sectional view taken along line XI—XI of FIG. 10.
Figure 11B:
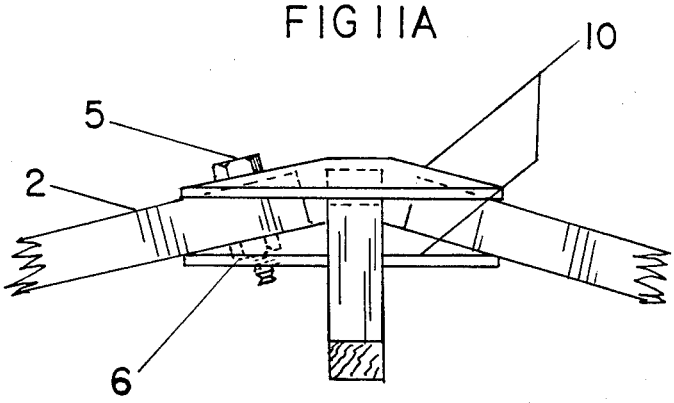
FIG. 11B is a cross-sectional view taken along a broader line XXII—XXII of FIG. 10.

FIG. 10 shows a further type of connection for use in the invention where unflattened ends of elements 2 (round or square members) are sandwiched between two substantially conically-shaped plates or discs 10 as shown in FIG. 11, and rigidly connected thereto by a bolt 5′ and nut 6′ arrangement, the bolt being inserted through aligned holes in the connector discs and ends of elements 2.

The connection devices have been described above primarily as used with tubular structural elements 2. However, it is to be understood that elements 2 can be solid wood members, for which the connectors shown in FIGS. 8–10 are particularly suitable. For example, a square cross-section end of a wooden rod type element 2 would fit snugly between the flanges of the legs of the angle member 8.

The length and diametral size of structural elements 2 are pre-determined depending upon the desired size of the shelter which in turn depends on the size of the object or objects to be sheltered. For example, to house one airplane the wing span of the airplane is the primary determining factor for the size of the hangar, and for a wing span of approximately 30 ft., it has been found that 2 inch O.D. tubular pipe having a length of between approximately 8 ft. 3 in. and 12 ft. 6 in. is desirable, although these dimensions can be varied depending on prevailing environmental conditions, such as winds. The length of these members are directly proportional to the radius of the ellipsoid of revolution. To develop a larger hangar to house two or more airplanes, the length of each member will be longer than cited above. In some cases it may be desirable to decrease the length of these elements so the diameter of the member can also be reduced. This can be accomplished by increasing the number of triangles the surface is divided into. This results in a decrease in triangle size and member length. This can be done without altering the general shape of the structure.

As shown in FIGS. 1, 2 and 3, the geodesic structure includes groundline structural elements since this is the sturdiest construction. Also in the preferred embodiment the vertices of the triangular sections that are along or adjacent the groundline are anchored to the ground in the manner shown in FIG. 15 wherein large stakes 11 of suitable material such as wood, metal or heavy duty plastic, are driven into or planted in the ground, each containing an eyemember 12 embedded or fixed therein. For more permanent installations, these stakes can be replaced by poured in situ concrete members, or footings, and include earth anchors 13, if desired. The flattened ends of elements 2 are attached to the eye members 12 by a bolt and nut arrangement 14. It is also possible to eliminate the elements 2 along the groundline if the anchoring stakes are sufficiently rigidly affixed in the ground so that the additional stability provided by these elements is not necessary. Such elimination of parts would reduce the cost of the structure.

For applications requiring a large opening the important features of the reinforced doorway will now be described. In order to provide sufficient strength and stability to the geodesic framework where a portion has been left open to provide a doorway by omitting certain triangular sections, my invention provides a novel reinforcing truss shown principally in FIG. 1, with subcomponents thereof being shown in FIGS. 12, 13 and 14. With reference to FIG. 1, the truss is shown in elevation and comprises reinforcing elements 15, 16 extending from connection joints 17, 18, at an inclined angle across the upper part of the opening towards the center where they are connected by their ends to element 19. This connection is shown in greater detail in FIG. 13 and comprises members 20, 21, 22 such as lengths of angle or channel iron, welded into a wide angle configuration to snugly receive the end portions of elements 15, 16 in the channels of the opposite ends thereof at 21, 22, respectively. Pipe-clamps, U-clamps or similar suitable fasteners 23 are used to rigidly clamp the member 20 to horizontal element 19 and members 15, 16.

Figure 12:
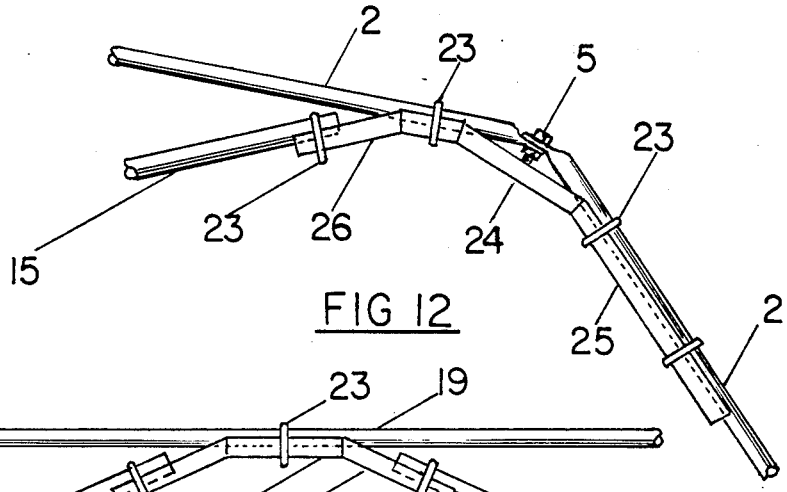
FIG. 12 is an enlarged elevational view of the corner connection of the elements in circle XII of FIG. 1.
Figure 13:
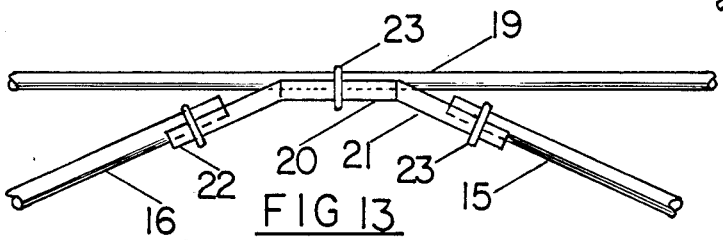
FIG. 13 is an enlarged elevational view of the connection of the elements in circle XIII of FIG. 1.

In a similar manner, reinforcing members 15, 16 are attached at their other ends as shown in FIG. 12, to the structural elements 2 at the apices 17, 18 by channel members 24 and clamps 23. In this connection, however, the lower end 25 of channel member 4 may be longer than the other end 26. Of course, if the installation is to be more permanent, these connecting members 20, 24 can be welded in place, if desired.

Figure 14:
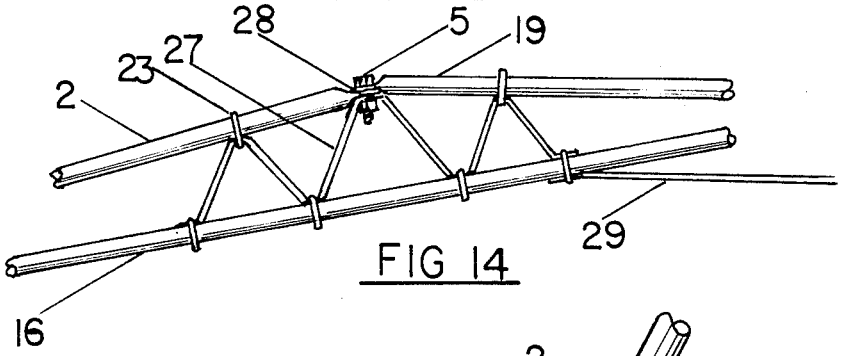
FIG. 14 is an enlarged elevational view of the reinforcing truss elements in circle XIV of FIG. 1.
Figure 15:
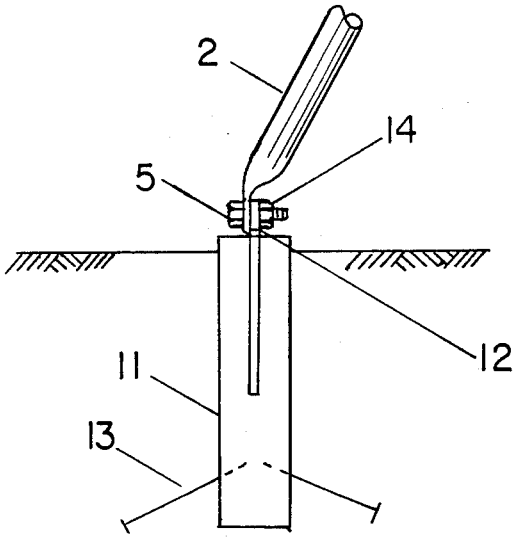
FIG. 15 is an enlarged view of the ground connection for the lower ends of the structural elements.

The truss further includes reinforcing struts 27, 29, best shown in FIG. 14, each of which is comprised of a single elongated rod-like or tubular member strut 27 being bent into a sinuous form having substantially straight sections between the bends. The rod-like or tubular member 27 is flattened in the preferred embodiment at its ends and in the region of each bend so that it may be more closely fitted to the structural members 2 and 19 and reinforcing members 15, 16 in the area where it contacts these members. Pipe-clamps, U-clamps, or similar clamping devices 23 securely fasten the strut members to members 2, 19 15, 16 at the flattened portions. The central flattened portion of 27, however, may be drilled to provide a hole to engage bolt 5 at connection point 28 as shown in FIG. 14. In areas where heavy loads are anticipated from wind or snow an additional member may be installed on each side. These members 41 are shown in FIG. 1 connecting to points 17 and 18 and a ground anchor 11 (FIG. 15). This support piece 41 is not shown in FIG. 12 but when installed the upper flattened end can be bolted to piece 24.

Figure 4:
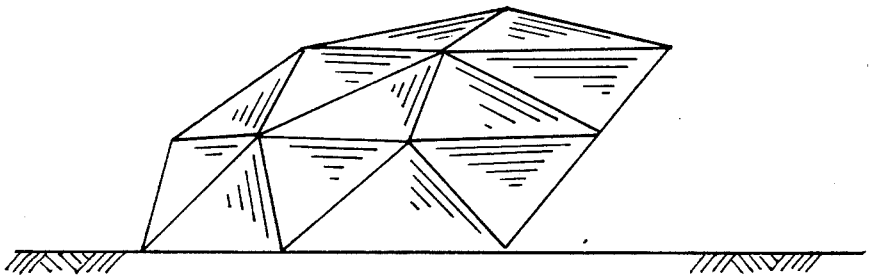
FIG. 4 is a left side view similar to FIG. 3 and showing the framework with a cover fitted on the outer side.
Figure 22:
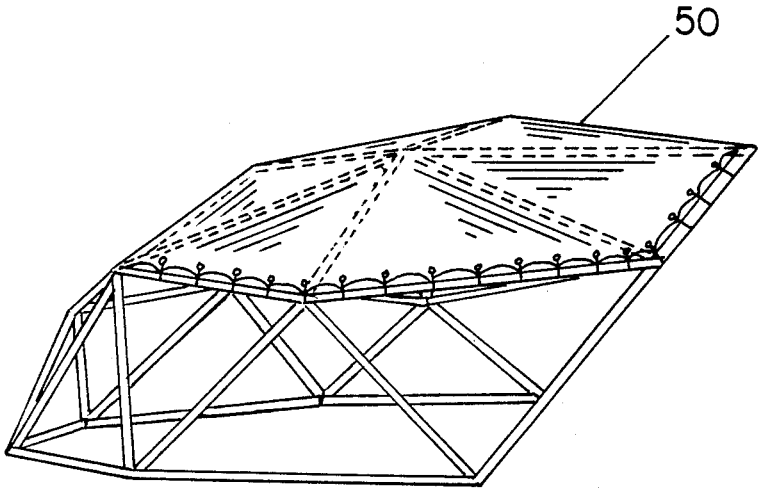
FIG. 22 is a schematic view showing the embodiment of the cover on top of the framework.
Figure 23:
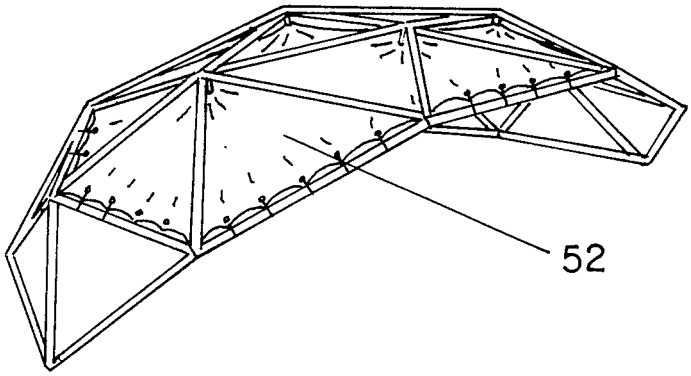
FIG. 23 is a view similar to FIG. 22 showing the embodiment of the cover supported within the framework.

After completing the structural framework previously described, a cover is provided and may be of several types as shown in FIGS. 4 and 16–21. In FIG. 4, the cover is a single sheet of flexible material such as heavy duty vinyl or plastic. This may also be transparent sheet material if desired for some reason, such as use of the invention as a greenhouse or solar heating device. The sheet material may be layed over and stretched on the top of the framework and fastened in a suitable fashion as shown at 50 in FIG. 22 or may be supported within the framework by suitable suspension devices for example as shown at 52 in FIG. 23.

Figure 16:
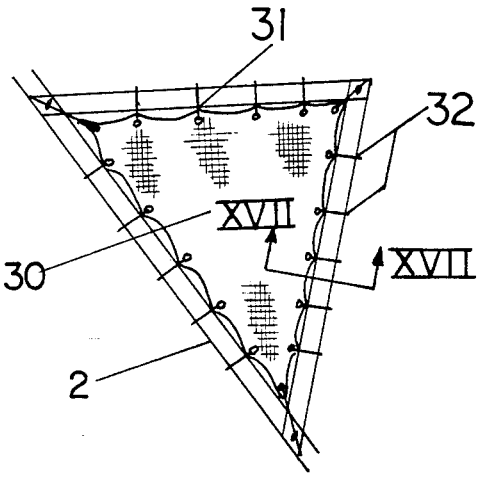
FIG. 16 is an elevational view of one section of the framework showing an alternate type of cover.
Figure 17:
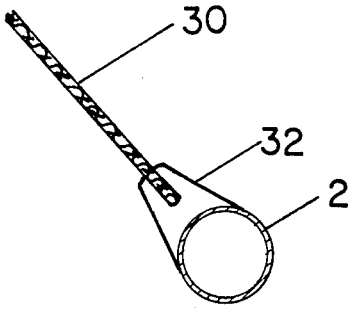
FIG. 17 is a cross-sectional view taken along line XVII—XVII of FIG. 16.

In FIGS. 16–17 an alternate type of covering is shown comprising triangular shaped sections 30 of flexible sheet material inserted into the openings between structural elements 2 of the framework and having eyelets 31 along their edges to receive suitable clamps, straps, or heavy thread 32 for attaching them in place.

Figure 18:
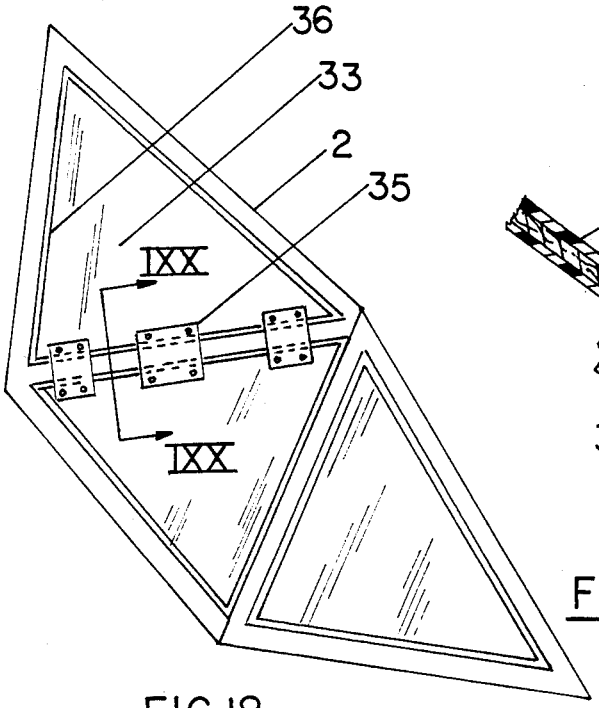
FIG. 18 is an elevational view of one section of the framework showing another alternate type of cover.
Figure 19:
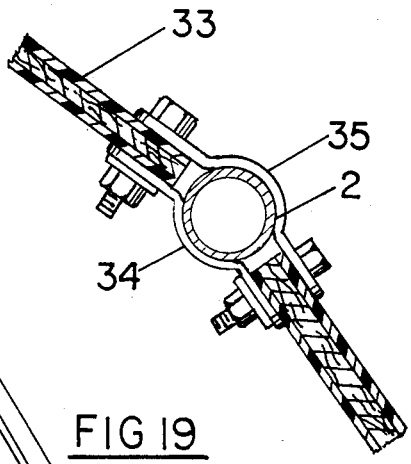
FIG. 19 is a cross-sectional view taken along line IXX—IXX of FIG. 18.

In FIGS. 18–19 is shown an alternate cover comprised of triangular shaped sections 33 of rigid composite board material fitted in the spaces between structural elements 2 and fastened in place by clamping members 34,35 which are preformed from flat sheet metal, plastic or other suitable material to engage elements 2 in their central portions and overlap the triangular sections at their ends where they are attached to these sections by bolt and nut arrangements 3. The sections 33 may be sealed along their edges where they adjoin elements 2 by suitable caulking 36, if desired.

Figure 20:
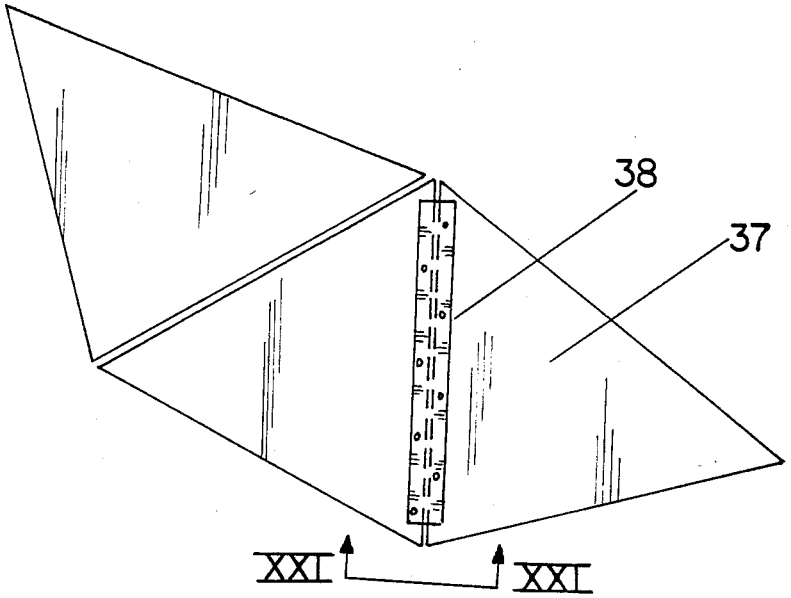
FIG. 20 is an elevational view of several sections of another alternate type of cover.
Figure 21:
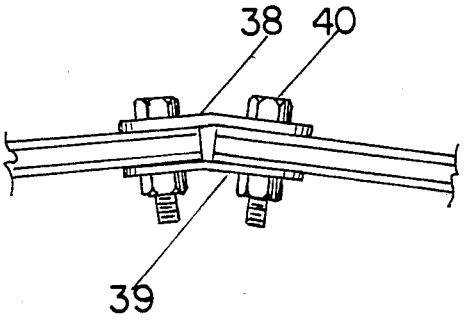
FIG. 21 is a view taken from the line XXI—XXI of FIG. 20.

The alternate cover construction shown in FIGS. 20–21 comprises rigid sections 37 such as shown in FIGS. 18–19 joined together at their adjacent edges by substantially rigid elongated clamping members 38, 39 bent to the desired angle and disposed on opposite sides of the sections, as shown in FIG. 21, and fastened thereto by bolt and nut arrangements 40. This cover may be superimposed over the top of the framework previously described or may be supported within and by the framework by suitable suspension or attachment devices (not shown). The alternate construction shown in FIGS. 20–21 can also be made having sufficient strength and rigidity to be self-supporting without the use of the structural framework. In such case the shelter would have a general appearance similar to the geodesic structure of FIGS. 1, 2, 3 and 4 when covered, but without elements 2. This self-supporting structure would be anchored to the ground in the same manner as described above with reference to FIG. 15 except that the eyeleted connector 12 would be attached to sections 37 rather than elements 2.

I claim:

1. A shelter comprising a plurality of structural elements connected together at apecis to form a geodesic dome type structure having the shape of a semi-ellipsoid, and a substantially planar door opening extending substantially in a plane passing through the greatest axis of the semi-elllipsoid, said greatest axis being substantially horizontal to the ground and lying in said plane, said door opening extending upwardly from said axis at an angle outwardly with respect to said structure and passing substantially through a plurality of said apecis to form an overhang at the upper portion of the doorway opening, so that said doorway opening is self-supported without vertical supports and substantially equal to the width of said structure at the bottom and accommodates maximum size objects in relation to the size of the structure.

2. A shelter as claimed in claim 1 wherein said structural elements comprise elongated members and means to removably connect said elongated members together at their ends to form a framework, and further comprising a reinforcing truss means extending over said doorway opening comprising elongated reinforcing elements extending from the first apex above ground at each side of said opening slanting upwardly towards the center of the top of said opening, means to removably connect the upper ends of said reinforcing elements to the central region of the horizontal structural element over the central part of said opening and means to removably connect the lower ends of said reinforcing elements to the structural elements at said apecis.

3. A shelter as claimed in claim 2 wherein said connecting means for the upper ends of said reinforcing elements comprises an angle member having a substantially V-shaped cross-section, and being shaped to form a central portion and two end portions extending at an angle from said central portion, said upper ends of said reinforcing elements being snugly received in the end portions of said V-shaped angle member, said horizontal structural member being snugly received in said central portion of said V-shaped angle member, said connecting means for each lower end of said reinforcing elements comprise an angle member having a V-shaped cross-section and being shaped to snugly receive in the angle thereof at its upper end the lower end of the respective reinforcing element and in a portion adjacent thereto the structural element extending upwardly over said opening from the respective apex, and in the lower end the structural element extending from said apex downwardly at the edge of said opening, and pipe clamps attaching said angle members to said elements.

4. A shelter as claimed in claim 3 wherein said structural elements are tubular pipe members having flat ends with holes therethrough, said ends being connected together by overlying said flat ends with said holes aligned and bolt and nut arrangements rigidly retaining said ends together, said truss further comprising reinforcing rod-like members each bent into a plurality of substantially straight sections each extending at an angle with respect to each other and spanning between each respective reinforcing element and the adjacent structural elements, and pipe clamps rigidly attaching the bends and ends of said rod members to the respective structural elements and reinforcing elements.

5. A shelter as claimed in claim 4 wherein said cover means comprises flexible sheet material drawn over the top of said framework and fastened thereto.

6. A shelter as claimed in claim 4 wherein said cover means comprises triangular shaped sections conforming to the triangular openings in the geodesic framework and means to removably attach said sections to said framework.

7. A shelter as claimed in claim 4 wherein said cover means comprises flexible sheet material suspended from the connection joints of said structural members.

8. A shelter as claimed in claim 6 wherein said triangular shaped sections are comprised of rigid panels, and said removable attachment means comprises plate type clamping members removably attached to the edges of said panels and enclosing the structural member therebetween.

9. A shelter as claimed in claim 6 wherein said triangular shaped sections are comprised of flexible material, and said removable attachment means comprises flexible ties.

10. A shelter as claimed in claim 1 wherein said structural elements comprise triangular sections of rigid board material, said sections being rigidly held together by plate type clamping members removably attached to the adjacent edges of said sections, said cover means comprising the outer surfaces of said sections, and further comprising a reinforcing truss means extending over said doorway opening comprising elongated reinforcing elements extending from the first apex above ground at each side of said opening slanting upwardly towards the center of the top of said opening, means to removably connect the upper ends of said reinforcing elements to the central region of the horizontal structural element over the central part of said opening and means to removably connect the lower ends of said reinforcing elements to the structural elements at said apecis.

11. A shelter as claimed in claim 1 wherein said structural elements are connected together by a star-shaped connector comprising a plurality of angle members having a V-shaped cross-section rigidly joined together at one end of each angle member, said angle members extending from the central part of the rigid joint radially substantially parallel to the longitudinal axis of said structural elements, said structural elements being nested in said angle members in self-aligning relationship therewith and fastened rigidly thereto.

12. A shelter as claimed in claim 1 wherein said structural elements are connected together by a connector comprising two substantially conically shaped clamping members having smooth undeformed surfaces, the joined ends of the structural elements being clamped between said clamping members rigidly connected thereto clamping said structural elements therebetween to form a rigid joint, the apecis of said conical members substantially coinciding with the geometric center of said joint.

13. A shelter as claimed in claim 1 and further comprising, anchor means rigidly fixed to the ground and removably attached to said structure.

14. A shelter comprising: a plurality of structural elements connected together to form a geodesic dome type structure; said structural elements being elongated tubular pipe members having flat ends with holes through the ends, said flat ends being overlaid with said holes aligned and rigidly connected together by bolt and nut arrangements with the bolts extending through said aligned holes forming apecis of the geodesic structure so that the structure has the shape of a semi-ellipsoid of revolution with the diametral plane thereof being substantially horizontal to the ground; a doorway opening in the surface of the structure having a width extending substantially parallel to one of the axes of said ellipsoid and a height less than one-half of the other axis of said ellipsoid; a reinforcing truss means extending over said doorway opening comprising elongated reinforcing elements extending from the first apex above ground at each side of said opening slanting upwardly towards the center of the tip of said opening; an angle member having a substantially V-shaped cross-section and a shape forming a central portion and two end portions extending at an angle from said central portion, the upper ends of said reinforcing elements being snugly received in the end portions of said V-shaped angle member and the horizontal structural element over the central part of said doorway opening being snugly received in said central portion of said V-shaped angle member; angle members each having a V-shaped cross-section and a shape to snugly receive in the angle thereof at its upper end the lower end of one of the reinforcing elements and in a portion adjacent thereto the respective structural element extending upwardly over said opening from the respective apex, and in the lower end the respective structural element extending from the respective apex downwardly at the edge of said opening; removable pipe clamps attaching said angle members to said elements; reinforcing rod-like members each bent into a plurality of substantially straight sections each extending at an angle with respect to each other and spanning between each respective reinforcing element and the adjacent structural element; pipe clamps rigidly attaching the bends and ends of said rod members to the respective structural elements and reinforcing elements; anchor means rigidly fixed in the ground and removably attached to said structure; and cover means to substantially cover the area within said structure.

15. A shelter as claimed in claim 14 wherein said cover means comprises flexible sheet material drawn over the top of said framework and fastened thereto.

16. A shelter as claimed in claim 14 wherein said cover means comprises triangular shaped sections conforming to the triangular openings in the geodesic framework and means to removably attach said sections to said framework.

17. A shelter as claimed in claim 14 wherein said cover means comprises flexible sheet material suspended from the connection joints of said structural members.

18. A shelter as claimed in claim 16 wherein said triangular shaped sections are comprised of rigid panels, and said removable attachment means comprises plate type clamping members removably attached to the edges of said panels and enclosing the structural member therebetween.

19. A shelter as claimed in claim 16 wherein said triangular shaped sections are comprised of flexible material, and said removable attachment means comprises flexible ties.

20. A shelter comprising:

a plurality of structural elements connected together to form a geodesic dome type structure; said structural elements being elongated tubular pipe members; star-shaped connectors connecting the ends of a plurality of said tubular pipe members together at apecis of said geodesic dome structure, each comprising a plurality of angle members having a V-shaped cross-section rigidly joined together at one end of each angle member, said angle members extending from the central part of the rigid joint radially parallel to the longitudinal axis of said structural elements, said structural elements being nested in said angle members in self-aligning relationship therewith; releasable means to fasten said structural elements rigidly to respective angle members, so that the structure has the shape of a semi-ellipsoid of revolution with the diametral plane thereof being substantially horizontal to the ground; a doorway opening in the surface of the structure having a width extending substantially parallel to one of the axes of said ellipsoid and a height less than one-half of the other axis of said ellipsoid; a reinforcing truss means extending over said doorway opening comprising elongated reinforcing elements extending from the first apex above ground at each side of said opening slanting upwardly towards the center of the tip of said opening; an angle member having a substantially V-shaped cross-section and a shape forming a central portion and two end portions extending at an angle from said central portion, the upper ends of said reinforcing elements being snugly received in the end portions of said V-shaped angle member and the horizontal structural element over the central part of said doorway opening being snugly received in said central portion of said V-shaped angle member; angle members each having a V-shaped cross-section and a shape to snugly receive in the angle thereof at its upper end the lower end of one of the reinforcing elements and in a portion adjacent thereto the respective structural element extending upwardly over said opening from the respective apex, and in the lower end the respective structural element extending from the respective apex downwardly at the edge of said opening; removable pipe clamps attaching said angle members to said elements; reinforcing rod-like members each bent into a plurality of substantially straight sections each extending at an angle with respect to each other and spacing between each respective reinforcing element and the adjacent structural element; pipe clamps rigidly attaching the bends and ends of said rod members to the respective structural elements and reinforcing elements; anchor means rigidly fixed in the ground and removably attached to said structure; and cover means to substantially cover the area within said structure.

* * * * *